United States Patent [19]

Reed

[11] Patent Number: 4,738,066

[45] Date of Patent: Apr. 19, 1988

[54] DECORATIVE CEILING SYSTEM

[75] Inventor: Jim E. Reed, Cedar Rapids, Iowa

[73] Assignee: Woodtech, Inc., Cedar Rapids, Iowa

[21] Appl. No.: 796,174

[22] Filed: Nov. 8, 1985

[51] Int. Cl.[4] ..... E04B 5/52

[52] U.S. Cl. ..... 52/484; 52/488; 52/664

[58] Field of Search ..... 52/311-316, 52/484, 487, 309.4, 309.11, 309.14, 144, 15, 660, 664, 666, 668, 669, 507, 663, 488; 181/290, 292, 287

[56] References Cited

U.S. PATENT DOCUMENTS

| | | | |
|---|---|---|---|
| 6,186 | 12/1874 | Groat | 52/666 |
| 846,291 | 3/1907 | Emerson | 52/666 |
| 1,635,796 | 7/1927 | Little | 52/144 |
| 1,703,011 | 2/1929 | Mazer | 52/144 |
| 2,014,694 | 9/1935 | Olschner | 181/292 |
| 2,131,485 | 9/1938 | Schwensen et al. | 52/144 |
| 2,239,394 | 4/1941 | MacKechnie | 52/664 |
| 4,441,294 | 4/1984 | Riley | 52/662 |
| 4,545,165 | 10/1985 | Carey et al. | 52/668 |

FOREIGN PATENT DOCUMENTS

| | | | |
|---|---|---|---|
| 674904 | 12/1963 | Canada | 52/664 |
| 622470 | 11/1935 | Fed. Rep. of Germany | 52/144 |
| 2363676 | 3/1978 | France | 52/309.14 |
| 7400362 | 7/1975 | Netherlands | 52/507 |
| 178452 | 10/1935 | Switzerland | 52/144 |

*Primary Examiner*—James L. Ridgill, Jr.
*Attorney, Agent, or Firm*—James C. Nemmers

[57] ABSTRACT

A decorative suspended ceiling system in which panels containing strips of decorative material, such as wood, are designed to be installed in connection with a standard metal grid system. The panels are laid in place in the grid and are therefore easily removed for access to the area above the suspended ceiling. When installed, the grid is camouflaged by the panels giving the appearance of a free-flowing ceiling with uniform spacing between all of the decorative members.

6 Claims, 2 Drawing Sheets

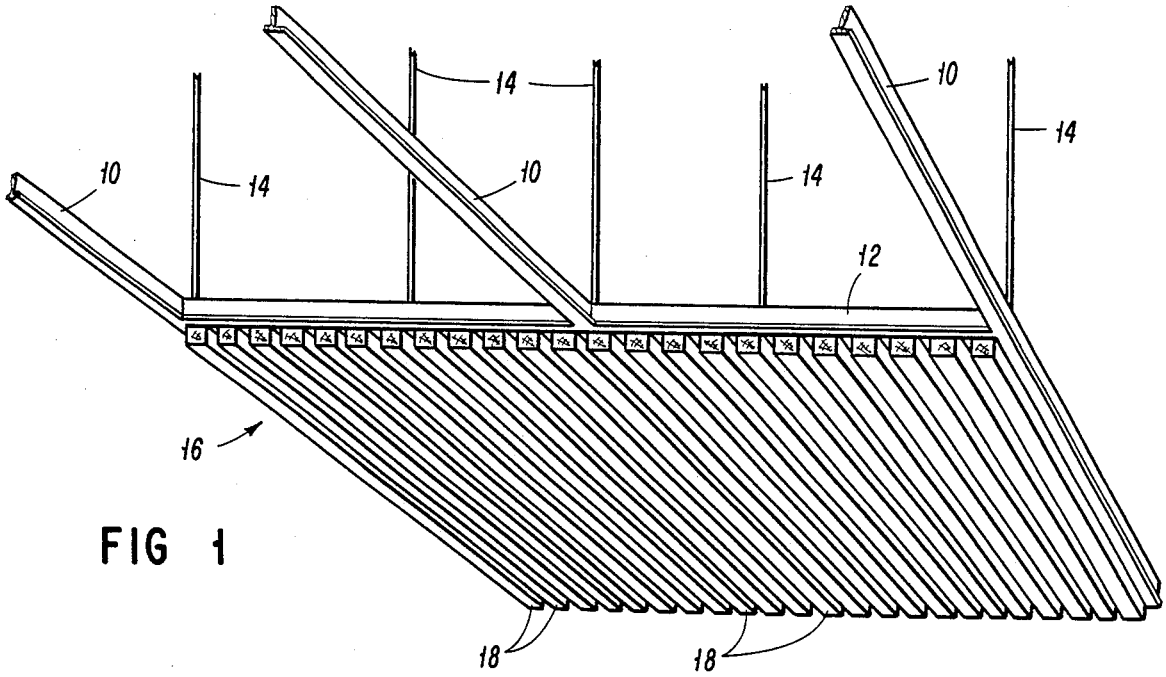
FIG 1
FIG 2
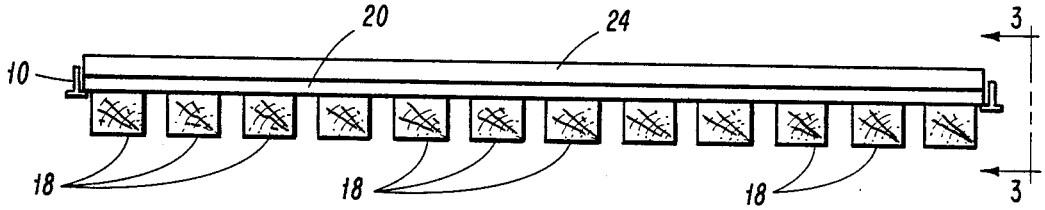
FIG 3
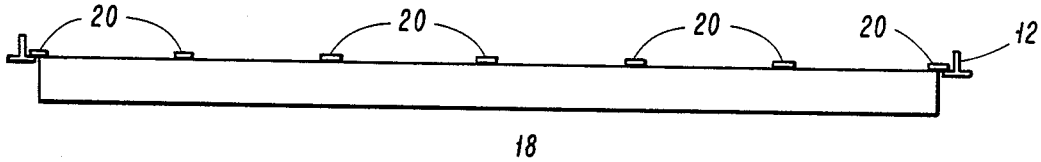
FIG 4
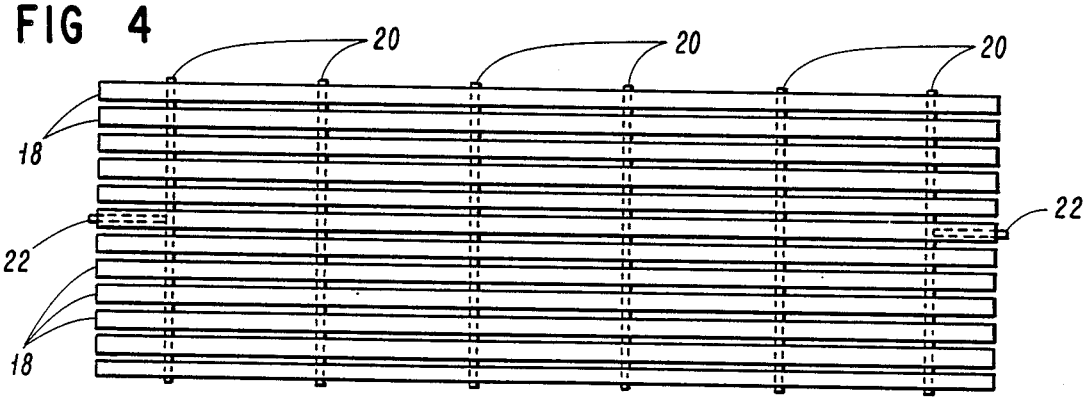

DECORATIVE CEILING SYSTEM

BACKGROUND OF THE INVENTION

In modern times, ceiling systems have been vastly improved by the development of suspended ceilings in which metal grids which resemble inverted "T's" are supported from above, with the individual supports being positioned in parallel spaced-apart distances to receive removable panels of the desired ceiling material. Generally, cross supports are also suspended at regular spaced-apart distances to receive mass-produced panels of a predetermined size. Commonly, such panels are 2'×2' or 2'×4' although spacings vary depending upon the desired result. Also, larger spacings between the supporting members of the grid are often provided to receive light fixtures, heating and air conditioning vents, etc. In recent times, products have been marketed that utilize strips of wood or other decorative material that attempt to provide a free-flowing appearance. However, known ceiling systems of this type are difficult to install in that they utilize screws into the supports or require the use of dowels extending between and transversely to the decorative strips, with special fasteners being used in conjunction with the dowels to suspend the panels from the grid. Once installed, ceiling systems of this type do not provide ready access to the area above the grid. Such access is often needed for repairs to electrical plumbing and heating and ventilating systems. Also, known systems of this type are not as attractive since the cross dowels are exposed for view. Also, the grid system in which known panels lay is exposed rather than concealed thus detracting somewhat from the aesthetic overall appearance of the completed installation.

There is therefore a need for an improved ceiling system of this type which is more easily installed, less expensive to manufacture and install and one which provides easy and ready access to the area above the grid system. Such a system should also provide a continuous, free-flowing appearance that camouflages the support system resulting in an extremely attractive finished ceiling.

SUMMARY OF THE INVENTION

The decorative suspended ceiling system of the invention is made up of panels containing strips of wood or other decorative material that are parallel and evenly spaced-apart. The panels are provided in standard widths and lengths so as to fit a 9/16" grid system. The individual wood or other decorative strips are mass produced by fastening them to cross members which are used to support the panels in the grid system. When installed, the grid system is completely camouflaged by the panels giving the appearance of a free flowing and uninterrupted ceiling with equal spacing between all of the decorative members. Since the panels are lay-in panels, they provide easy access to the area above the grid system.

BRIEF DESCRIPTION OF THE DRAWINGS

FIG. 1 is a perspective view of a portion of a ceiling system made according to the principles of the invention and showing adjacent panels in place;

FIG. 2 is an end view of a lay-in panel and illustrating the manner in which the panel is supported on the grid system;

FIG. 3 is a side view of a panel taken on the line 3—3 of FIG. 2 but with the longitudinal T-support now shown for purposes of clarity;

FIG. 4 is a plan view of a panel constructed according to the principles of the invention.

DESCRIPTION OF THE PREFERRED EMBODIMENT OF THE INVENTION

Figure 5:
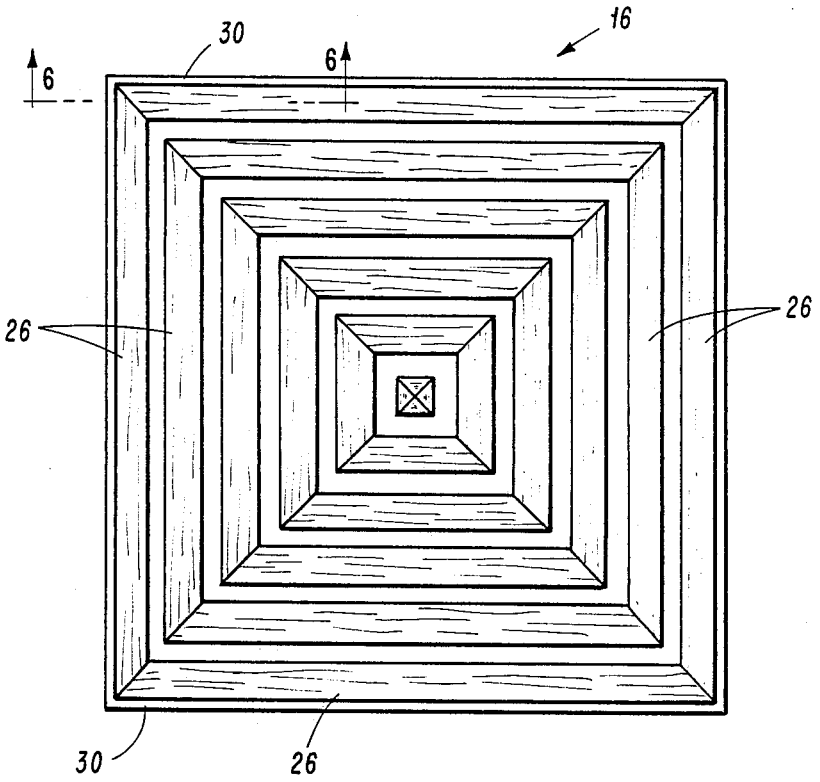
FIG. 5 is a plan view of a panel showing a different pattern for a ceiling panel.

Referring first to FIG. 1, there is illustrated a portion of a ceiling that has been constructed utilizing the principles of the invention. The panels of the invention and the system of installation utilize a 9/16" metal grid system which includes longitudinally extending supports 10 which are of a general inverted "T" configuration and cross supports 12 which are also of a "T" configuration. The longitudinal supports 10 are spaced-apart predetermined distances corresponding generally to the size of the standard panels available to form the ceiling. Generally, the longitudinal supports are of a 2 feet center-to-center spacing. The cross supports 12 are also parallel to each other and are spaced-apart a predetermined distance depending upon the length of the panels that are to be laid in on the grid system. Generally, the spacing of the cross supports 12 is at least 2 feet, and with the panels of the invention a preferred length is 8 to 10 feet. The longitudinal supports 10 and cross supports 12 are suspended from above by suitable supports such as vertical rods 14 as is well known in the building trade. When the grid system is completely installed, rectangular spaces will be provided between the longitudinal supports 10 and cross supports 12, with these spaces generally being of the same size. Obviously, along the edges of walls or other obstructions, these spaces may be smaller, and, as is well known, the standarized panels that are to be laid in must be cut to fit the non-standard spaces made necessary by reason of the walls or other obstructions. Also, if light fixtures or heating and ventilating outlets are to be installed, the spacing between the supports that comprise the grid system may have to be varied. The advantage, of course, of the grid system is the flexibility that is provided by it.

Panels constructed according to the principles of the invention can be of any desired width and length, but preferably are constructed so as to be 2 feet wide and up to 10 feet in length. Each panel, which is indicated generally by the reference numeral 16, is comprised of a plurality of decorative strips 18 that are spaced-apart a predetermined distance. The decorative strips 18 may be made of wood, and if so, the strips 18 may be 1 7/16" wide and 2" on center leaving a 9/16" space between the strips 18. The strips may be of any desired thickness, but for the indicated width and spacing I prefer the strips to be ¾" thick.

The decorative strips 18 are held in place by being fastened to cross members 20 in any suitable manner such as the use of wood screws. As best seen in FIG. 4, the ends of the cross members 20 extend slightly beyond the outside edge of the outermost strips 18 so that the completed panel can be laid onto the edges of the longitudinal supports 10 as best seen in FIG. 2. When a panel is constructed as described above, and using the dimensions indicated, the panel will fit exactly between longitudinal supports 10 that are on 24" centers, and when panels 16 are laid adjacent to each other, the spacing between adjacent panels will be exactly 9/16". This thus provides a uniform spacing not only between strips 18 but between panels laid between adjacent longitudinal supports 10 of the grid system.

Normally, cross supports 12 would not be needed, and panel 16 would be laid end-to-end between longitudinal supports 10. This would thus provide a continuous, free-flowing appearance. However, if for any reason it is necessary to provide additional support by use of a cross support 12, either a cross member 20 can be installed near the ends of the strips 18 as shown in FIG. 3 or, as shown in FIG. 4, end members 22 can be fastened to the top of the middle strip 18 so that the end member extends beyond the end of the panel 16.

Also, the panels of the invention easily facilitate the installation of an insulating material 24 that can be permanently attached to the back or upper side of the panel as indicated in FIG. 2.

Figure 6:
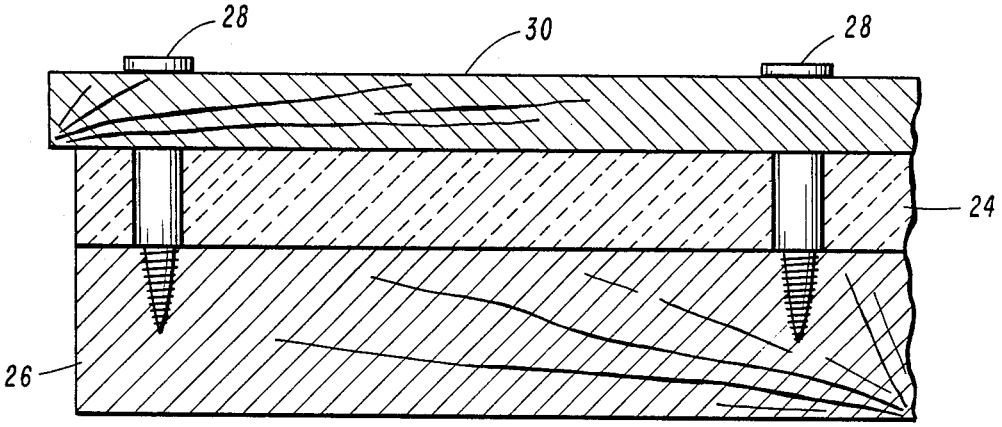
FIG. 6 is a sectional view of a portion of the panel of FIG. 5.

In FIGS. 5 and 6 there is illustrated a second embodiment of the invention, which embodiment provides a panel 16 of a different design. In this second embodiment, the decorative strips 26 are arranged in a non-linear pattern to produce a design of the desired type. Obviously, designs other than that shown in FIG. 5 could be used. In any event, the individual strips 26 are secured by suitable fasteners, such as wood screws 28, to a one-piece, rectangular backing 30 the outer edge of which extends slightly beyond the outer edge of the strips 26 so as to provide a ledge for supporting the panel 16 on the flanges of the supports 10 similar to that of the first embodiment.

Preferably, a blanket of insulating material 24 is sandwiched in between the strips 26 and the support 30.

When the panels 16 are properly installed, and particularly if the supports 10 and 12 are black and the lower surface of the insulating material 24 is also black, no visible support can be seen, and the completed ceiling has an aesthetically appealing, free-flowing appearance of just wood strips suspended. From the foregoing description, it will be evident that the panels of the invention make it possible to achieve this free-flowing effect using lay-in panels. Since the panels 16 are designed to lay in a grid system utilizing supports 10 and possibly supports 12, each individual panel 16 provides accessibility above the grid system without disturbing any other panel. All that is necessary is to raise the panel 16, tip it and remove it. Frequently, such accessibility is necessary for electrical, plumbing or heating and ventilating repairs. After such repairs are made, the panels are easily and quickly replaced thus assuring continued perfect alignment of the ceiling. With the ceiling system of the invention, it is not necessary to call in a ceiling contractor to remove and reinstall the ceiling sections. This can be done by the technician who is also doing the particular repairs. Thus, this ease of accessibility and accessibility to any place in the ceiling results in a substantial cost savings in maintenance dollars.

A further advantage of the ceiling system of the invention is that it is not necessary to stop construction of the ceiling because of scheduling problems with other subcontractors such as lighting, heating and plumbing contractors. The ceiling can be completed, and the work of the other subcontractors done at a later date. This thus results in increased efficiency for the general contractor.

Moreover, panels constructed according to the principles of the invention are more easily installed in irregular areas than are other wood ceilings. All that is necessary is that the panels be cut to fit, and although not usually necessary, additional cross members 20 could be installed to provide the supports for a particular irregular area.

Also, some insulation is attached and can be an integral part of every panel, the panels provide high acoustical and insulation value. This value is always retained since the insulation is not easily damaged during installation or during maintenance.

Obviously, the panels of the invention are easily assembled on a mass production basis at a cost substantially lower than existing products. They can be customed designed to fit almost any existing grid system or grid systems designed to fit a custom installation. Having thus described the invention in connection with a preferred embodiment thereof it will be evident to those skilled in the art that various revisions and modifications can be made to the preferred embodiment as described herein without departing from the spirit and scope of the invention. It is my intention however that all such revisions and modifications as are obvious to those skilled in the art will be included within the scope of the following claims.

What is claimed is:

1. A ceiling having a grid system that includes longitudinally extending, parallel spaced-apart T-shaped supports each providing longiudinally-extending ledges, and a laid-in panel comprising: a plurality of decorative members all arranged in a parallel spaced-apart pattern parallel to the T-shaped supports and being spaced-apart the same distance as the width of the T-shaped supports, and support means joined to said decorative members above their top surfaces so as to maintain the decorative members in said pattern, said support means extending slightly beyond the sides of the outermost ones of the decorative members so as to rest upon the ledges of the supports of said grid system.

2. The ceiling of claim 1 in which insulation is affixed to the support means above the top surface of the panel.

3. The ceiling of claim 1 in which the support means includes a plurality of spaced-apart support strips, the strips being affixed to and positioned transversely of the decorative members, the ends of the support strips extending slightly beyond the sides of the outermost ones of the decorative members so as to rest upon the ledges of the supports of said grid system.

4. The ceiling of claim 3 in which insulation is affixed to the support strips above the top surface of the panel.

5. The ceiling of claim 1 in which the decorative members are longitudinally extending wooden strips, the spacing between the decorative strips being uniform along their length and substantially equal to the width of the T-shaped supports.

6. The ceiling of claim 5 in which insulation is affixed to the support means above the top surface of the panel.

* * * * *